United States Patent [19]

Doundoulakis

[11] 4,169,697

[45] Oct. 2, 1979

[54] ANGULAR COMPRESSION EXPANSION CYLINDER WITH RADIAL PISTONS

[76] Inventor: George J. Doundoulakis, 2498 Kayron La., North Bellmore, N.Y. 11710

[21] Appl. No.: 875,817

[22] Filed: Mar. 16, 1978

Related U.S. Application Data

[63] Continuation of Ser. No. 719,664, Sep. 1, 1976, abandoned, which is a continuation-in-part of Ser. No. 554,560, Mar. 3, 1975, Pat. No. 3,989,012.

[51] Int. Cl.[2] ..... F01C 1/42

[52] U.S. Cl. ..... 418/34

[58] Field of Search ..... 418/33, 34, 35, 36, 418/37, 38; 123/245

[56] References Cited

U.S. PATENT DOCUMENTS

| | | | |
|---|---|---|---|
| 1,095,730 | 5/1914 | Jacklin | 418/37 X |
| 1,142,576 | 6/1915 | Inshaw | 418/34 X |
| 2,061,131 | 11/1936 | Bancroft | 418/37 |
| 2,088,779 | 8/1937 | English | 418/35 |
| 3,169,487 | 2/1965 | Namikawa | 418/36 X |
| 3,933,131 | 1/1976 | Smith | 418/33 X |

*Primary Examiner*—Carlton R. Croyle
*Assistant Examiner*—Leonard E. Smith
*Attorney, Agent, or Firm*—Constantine A. Michalos; Peter C. Michalos

[57] ABSTRACT

An angular cylinder piston combination is disclosed for providing compression and expansion chambers in a large number of items, such as compressors, pumps, internal and external combustion engines, hydrostatic generators, air motors, and the like, in which compression and expansion chambers are formed angularly, inside a cylindrical drum which rotates at substantially uniform velocity "Wo" and connected to the output shaft. The chambers are formed between N outer radial pistons provided by the drum and N inner radial pistons attached to an inner rotor which accelerates and decelerates from zero velocity to a velocity "2Wo" with respect to a stationary housing. The inner rotor comprises a sleeve overlaying the output shaft and rotatably displacable in relationship therewith. A single port per chamber provides intake and exhaust as it comes into juxtaposition with slots, azimouthally cut on the base of a stationary housing. The inner radial pistons, oscillating within the angle subtended between the outer pistons, do not cross the ports. Lubricating oil can then be permitted to run between a pair of sealing elements positioned along those edges of the pistons which slide with respect to other members of the angular cylinder. The application of this angular cylinder provides the basis of an improved Tri-Rotor device.

4 Claims, 12 Drawing Figures

ANGULAR COMPRESSION EXPANSION CYLINDER WITH RADIAL PISTONS

FIELD OF THE INVENTION

This is a continuation of an application filed Sept. 1, 1976 with Ser. No. 719,664 now abandoned which itself is a continuation-in-part of Ser. No. 554,560, filed Mar. 3, 1975 now U.S. Pat. No. 3,989,012, all of the same inventor.

The invention relates to cylinder and piston combinations used to provide compression and/or expansion of fluids (including liquids and gases) in devices such as pumps, compressors, air motors, internal and external combustion engines and the like. In particular the preferred embodiment of the invention provides a cylinder with two bases and a cylindrical surface closed in the form of a drum, which is rigidly connected to, and constantly rotating with, the output shafts which is coaxial with the drum. The drum includes internal, rigidly attached radial pistons. These pistons extend radially inwardly from the cylindrical surface of the drum and are interleaved with other radial pistons rigidly supported by a rotor sleeved or telescoping over the output shaft. This rotor is azimouthally accelerated and decelerated with respect to the constantly rotating drum and output shaft.

DESCRIPTION OF THE PRIOR ART

The most common type of cylinder/piston combination for accomplishing compression and/or expansion of fluids in devices such as pumps, compressors, and internal and external combustion engines, is the linear cylinder where the volume is changed by the axial motion of at least one sliding piston. The fluid which is processed by the cylinder is allowed to enter the cylinder and later be expelled through valves which open and close passages at predetermined intervals, timed with respect to the rotation of a crankshaft.

Axial motion of pistons is usually associated with a crankshaft to which the pistons are connected via connecting rods. In the case of pumps and compressors external rotational torque is applied to the crankshaft, which in turn sets the pistons into axial motion via connecting rods. In the case of steam engines the axial motion of the pistons is converted into rotation of the crankshaft via connecting rods. In the case of internal combustion engines using axial pistons, there exists a first rotational energy from the fly-wheel action of an engine which is later converted into axial motion of the piston for compressing a fluid, such as air or a mixture of air and fuel. Subsequently, upon ignition of the fuel, the axial motion of the piston is converted into rotational torque on the crankshaft. The connecting rods between pistons and crankshaft are used, in the case of the internal combustion engines using axial pistons, to transfer energy in both directions, from the crankshaft to the axial pistons and vice versa. Since frictional losses occur in each direction of energy transfer, the liniar piston engine suffers from high friction losses.

Therefore, the conversion from linear to rotational motion is not accomplished without penalty. The force exerted toward the crank shaft lies along the direction of the connecting rod, while the piston force is directed along the axis of the cylinder. A force component, directed towards the piston rings therefore exists to balance those two forces. Forces directed toward the side of the cylinder contribute a frictional force (of the order of 14 lbs. per square inch of piston area), opposing the motion of the piston.

In as much as a single cylinder with its piston makes up an engine, most of the present day internal combustion engines comprise batteries of these engine units. An inherent problem in grouping cylinders is that they are geometrically incompatable with each other and therefore occupy excessive space. In addition, several other necessary but geometrically incompatable components such as a crank shaft and pairs of popping valves, are forced to work together.

The V-8 arrangement represents an improvement over a previous vertical configuration and accurate balancing has eliminated much of the objectionable vibration generated by the linear motion. Multi-cylinder piston engines utilize space very poorly and they are also very heavy. What the axially displaced piston engine has in its favor is the extensive research and development devoted to it over the years.

Since Watt's time, several attempts have been made to improve efficiency with rotary arrangements where the pressure inside the cylinder would act on radial pistons around the output shaft, so that interation would take place directly in terms of torque. The turbine is one such attempt. The Wankel engine is another such attempt. Still another type of rotary engine design, which has been proposed in various forms is based on what has been referred to as the "scissor action" pistons, shown in FIG. 1. While various arrangements have been set forth over the years for the control of the scissor action pistons, the pistons themselves, as a rule, are supported from around the center shaft 20 by coaxial or telescoping shafts such as 18 and 19 in an arrangement resembling that of a two section door hinge, where the flat sections represent the pistons 22*a*, 22*b*, 22*c* and 22*d*. The pistons are operating inside a stationary angular cylinder or case 24, which is part of the housing 26. The chambers 28*a*, 28*b*, 28*c* and 28*d* are formed between the housing 26 and the telescoping shafts 18 and 19; while its varying angular volume is determined by an angular seperation of the pistons such as 22*a* and 22*b*. When each telescoping shaft supports a pair of pistons, as is usually the case, there are four cavities formed inside the case 24, such as chambers 28*a*, 28*b*, 28*c* and 28*d*. They may execute the four strokes of the Otto cycle: intake, compression, power, and exhaust. To accomplish expansion and contraction of the chambers, one pair of pistons such as 22*a* and 22*c* are held fixed to provide abuttment against the stationary housing while the second pair of pistons, such as 22*b* and 22*d* execute a 90 degree rotation in a forward rotational direction. Then the second pair of pistons, 22*b* and 22*d*, is held fixed as an abuttment while the first pair of pistons 22*a* and 22*c* rotate 90 degrees in the forward rotational direction. This action is commonly referred to as "cat and mouse" action.

Actual scissor action engines have been built and reportedly have demonstrated impressive results, mainly in terms of power to weight ratio. At the same time scissor action engines have demonstrated these weaknesses:

(a) The pistons are held by the telescoping shafts 18 and 19 along a small portion of the height of each piston such as portions 32*a* and 32*b* respectively, and are cantilevered along the remaining portion of the height of each piston. Therefore along portions 33*a* and 33*b* of the pistons 22*a* and 22*b*, respectively, there is no support. The pistons thus provide inherently weak structures, unless substantial mass is devoted to them with a resulting increase in the mass moment of the inertia of the pistons and therefore reduction in their swiftness for fast acceleration.

(b) Sealing between adjacent chambers becomes a problem. This leads to two alternatives:

i. No special sealing elements are used. A space must be left between pistons 22*a*, 22*b*, 22*c*, and 22*d*, the case 24 of the cylinder 26 to preclude seizure between the piston and case due to unequal thermal expansion. This space contributes to loss of pressure and fuel.

ii. Sealing elements such as 42*a* and 42*b* corresponding to piston rings, are used. Difficulties arise in lubricating these elements. In the case of internal combustion engines, if oil is burned with gas, a continuous supply of oil must be provided which results in an increase in pollution products. If the oil is to flow around the pistons, between the sealing elements such as 42*a* and 42*b*, case 24, the oil can spill into the intake and exhaust ports, such as port 45, as well as in the spark plug opening, as the radial pistons pass over such ports. Sealing each piston along most of its periphery, presents difficulties. Sealing becomes easier in toroidal configurations but the problem of oil spilling in the ports still remains.

It is usually the passage of the pistons over the ports which determines the opening or closing of a port in the case of scissor action engines, rather than the use of popping valves. Wide and usually massive pistons are then needed to properly time intake and exhaust, with the sealing problems still outstanding.

In U.S. Pat. No. 3,989,012 entitled Three-Rotor Engine, issued to the same applicant, it has been shown that an improved rotary engine can be accomplished if one pair of pistons is supported inside a drum which constitutes an integral part with the output shaft located along the axis of the engine and is rotated at substantially constant speed, while the inner rotor, to which the inner pistons are attached, is telescoped over the output shaft.

The angular cylinders shown in said U.S. Pat. No. 3,989,012 has a drawback from the fact that the internal wall surface of the cylinder in which the radial pistons operate belongs to three separate members of the device; namely, to the two rotors which are used to hold the interleaved radial pistons, a first rotor providing the inner cylindrical wall surface and one flat base wall, the second rotor providing the other flat base wall of the cylinder and to the stationary case of an engine which provide the outer cylindrical surface of the cylinder in which the radial pistons operate. The weakness in this design lies in the fact that during the fuel explosion the internal surface of the engine would tend to be taken apart by the internal pressure. Thrust bearings at considerable loss in friction, therefore, would have to be used between the side rotors and housing to hold the cylinder in which the radial pistons operate from breaking apart.

Another weakness of the cylinder design in the Three Rotor Engine U.S. Pat. No. 3,989,012 is the excessive mass moment of inertial of the accelerated rotors. This mass moment of inertia is contributed by the rotor forming the outer base of the cylinder in which the radial pistons operate.

In the present invention, as shown in greater detail later, a cylindrical drum containing inwardly extending outer pistons connected to the output shaft as an integral part thereof. The rotor supporting the inner pistons intermitantly rotates about the output shaft with the inner pistons disposed within the drum. This arrangment makes it topalogically feasible to provide means of interaction between the inner rotor and the housing to provide the necessary reactive abuttment. According to Newton's third law, one cannot have action without an equal and opposite reaction. An engine cannot provide output torque unless during a power stroke one of the pistons abuts against the stationary engine case.

Several rotary engines have been proposed which do not provide for this essential reactive abutment and render those arrangments inoperable.

OBJECTS OF THE PRESENT INVENTION

It is the main object of the present invention to provide a rotary device for accomplishing compression and/or expansion for applications to pumps, compressors, and external and internal combustion engines.

It is a further object of the present invention that the rotary device be thermally more efficient, smoothly operating, simple in construction, smaller in volume and lighter in weight, than existing engines of both linear and rotary types.

It is another object of the present invention to provide an engine which is optimized to the extent that it employs, in combination, features which will allow it to yield the improved aforementioned performance. The objective combination has been arrived at through extensive computer analysis of the variables that contribute to a compression expansion device such as an engine. The following are the main considerations which have been used in the determination of the features in combination that a rotary device must include:

(a) Complience with Newton's third law providing that during each stroke there must exist a reation between the piston which is used as abutment and the stationary case of the engine, so that torque with respect to the stationary case of the engine becomes possible.

(b) Choice of pairs of inner pistons of variable velocity operating inside constantly rotating drums which provide the outer pistons as integral part of the drum. This choice provides rigidly supported inner pistons along their entire axial length and rigidly supported outer pistons along three of the faces of the pistons, compared to the scissor type pistons which are supported only by a limited portion of their axial length, and both pair of pistons are supported from the same side towards the axis of the device.

The outer piston drum type also requires shorter sliding contact edges between rotors per unit horsepower output than any other type of piston, including linear pistons and Wankel type rotor pistons.

(c) A constantly rotating drum so that the intake and exhaust ports, which are provided on the base of the drum will not be crossed over by the moving inner pistons. This feature will preclude mixture of gases of two consecutive chambers, one in the exhaust stroke, the other in the intake stroke. Further, this feature will allow lubricating oil to circulate between the pressure sealing elements (piston rings) connecting surfaces in relative motion, for reduction of friction and wear.

(d) The output shaft to be connected as a single integral member with the rotating drum so that half the torque as explained later, produced by the pressure chamber is communicated to the output shaft without the friction and other inefficiencies associated with transmission means such as gears, Geneva movements or cams and the like.

(e) The output shaft positioned along the axis of the rotary device. This feature first helps in the realization of a device of minimum size where the entire device is contained within a basic cylindrical configuration while eccentric output shafts greatly increase both volume and weight of the rotary device.

Another advantage of this feature is that the outer pistons, which receive direct forward pressure in a pressure chamber can directly and rigidly communicate such force to the output shaft by simply connecting the drum to the output shaft. The single output shaft can, at the same time, provide support through bearing to the one or two inner rotors, or the output shaft can be supported through bearings by the inner rotor which, in turn, can be supported through bearings by the stationary case.

In order that the device, as an engine, provide a power stroke during each stroke interval three rotor are required as explained in U.S. Pat. No. 3,989,012 entitled "Three Rotor Engine". In this case, the same shaft, along the axis, constituting one of the three rotors can allow the other two rotors to be telescoped around it and symmetrically with respect to the center of the output shaft. The telescoped rotors can serve as the two inner rotors required in the tri-rotor design, each carrying a pair of inner pistons and servicing a separate drum. The drum bases towards the center of the device can then be used to support a differential action engagement needed between the two inner rotors. This arrangement provides the following important topological advantages;

(i) Alternately one inner rotor, then the other during successive stroke intervals serves as abutment against the stationary case so that equal torque is provided by each drum to the output shaft during each successive stroke interval. This feature then helps to provide high power efficiency by substantially increasing the output power of the engine for a particular engine length and also providing a smoother operation in simulating a multicylinder engine. For example, a Tri-Rotor engine comprising two drums, each drum including a pair of inner pistons and a pair of outer pistons can provide 4 power strokes per drum, that is 8 power strokes per both drums per revolution of the output shaft. Since an 8 cylinder linear piston engine provides 4 power strokes per revolution, the Tri-Rotor engine is equivalent to a 16 cylinder engine thus generating twice the power for same RPM and same size combustion chamber. Since firing of both drums occurs simultaneously, the engine provides 4 torque impulses per revolution making it equivalent to an 8 cylinder linear piston engine at about ⅛ the actual size for same power output.

(ii) The two inner rotars are being accelerated and decelerated in a manner that the total rotational momentum in the inner rotars remains constant. As one rotor accelerates, the other decelerates at same rate so that the rotational energy of the output shaft is not being affected; the rotational momentum is effectively shifted from one inner rotor to other.

(iii) The topology of the present invention placing the output shaft at the center along the axis of the rotary device provides for two parallel walls, the bases of the drum towards the center of the device, which walls can be used as pivoting points for the differential device which is used to interengage the two inner rotors. It is through this device that the output shaft receives equal from each drum despite the fact that in one of the two drums the detonation occurs ahead of the outer pistons and therefore provides a negative force on the pistons. However, in such a drum, the inner piston also receives equal pressure causing it to be accelerated forward, and to rotate twice as fast as the output shaft which the inner piston in the other drum is used as an abutment against the case. The differential device interconnecting the two inner rotors, by using the walls of the drums as pivoting points exerts a force on the output shaft equal to twice the negative force inside the drum leaving a resultant of a positive force on the output shaft.

The purpose of the second inner rotor and the second drum is not to simply double the output but to provide a balanced and continuous system where a power stroke is provided whether the outer piston in the drum is ahead or behind the pressured gas being detonated.

(f) The drum to be enclosed on three sides rigidly so that the internal pressure will not take the engine apart or generate unacceptable friction as the drum walls rub against the stationary casing.

(g) Contacts between cylindrical surfaces in relative motion such as between the internal surface of the drum and the outer edge of the inner piston, are to be accomplished through pressure sealing elements equivalent to piston rings in linear piston engines, and not by direct contact of the surfaces to avoid seizure (binding) between members due to unequal thermal expansion or the creation of space through which pressure can get lost.

Since such pressure sealing aroung the intake and exhause ports would be hard to shape, and keep in contact with the cylindrical surface, the ports are to be preferably provided on the external bases of the drums. Another reason for this feature is that any spring loaded sealing around the ports contributing to a frictional force, would correspond to a lesser torque (torque being equal to force X radius) if the port is positioned closer to the axis for a reduction in the frictional torque.

SUMMARY OF THE INVENTION

In summary the present invention provides for a rotatable cylindrical drum tightly closed from three sides (the outer cylindrical surface and the two bases) with circular openings at the center of the two bases where an inner rotor can fit. The rotatable drum provides internally and rigidly attached to it a number of outer radial pistons; while the inner rotor also provides, rigidly attached to it, an equal number of inner radial pistons, as shown in FIG. 2, and 6 interleaved with the outer radial pistons. With the inner rotor and the drum mutually supported on bearings the side walls of the angular contraction expansion chambers, formed inside the drum, can withstand high pressures without the danger of coming apart and without the need for thrust bearings to prevent explosion of cylinder walls in the axial direction.

The outer radial pistons are rigidly attached on three sides inside the drums so that there is sliding contact only between the inner side of the outer radial pistons and the cylindrical wall surface of the inner rotor.

The inner radial pistons having a relatively low mass moment of inertia are connected to the inner rotor along their entire axial length and slide with respect to the inner drum wall on three of their sides.

The drum which provides the cylinder in which the radial pistons operate, is rotatably supported through bearings by the stationary structure of the housing and rigidly connected to a center shaft which is located along the axis of the device. Expansion and contraction of the chambers is accomplished by the inner rotor which holds the inner pistons, accelerating from zero speed with respect to the housing to a speed twice the speed of the uniformly rotating drum which holds the outer radial pistons.

Intake and exhaust can be accomplished as the ports which are cut on the outer base of the drum come in coincidence with slots azimouthally cut on the stationary base of the housing, with which the outer base of the drum is in continuous sliding contact. The inner radial pistons do not cross the ports; they simply effectively oscillate between the outer radial pistons which are attached inside the constantly rotating drum. Lubricating oil is permitted to circulate between pairs of sealing elements around the sliding edge of the radial pistons, without the danger of spilling into the input or exhaust ports.

The invention is also shown adapted as part of an improved Three Rotor device which can be used as an efficient pump, a compressor and external or internal combustion engine.

BRIEF DESCRIPTION OF THE DRAWINGS

The invention is illustrated diagrammatically in the accompanying drawings by way of examples. The diagrams illustrate only the principles of the invention and how these principles are embodied in various fields of application. It is however to be understood that the purely diagrammatic showing does not offer a survey of other possible constructions and a departure from the constructional features diagrammatically illustrated does not necessarily imply a departure from the pinciples of the invention.

It is therefore to be understood that the invention is capable of numberous modifications and variations apparent to those skilled in the art without departing from the spirit and scope of the invention.

In the accompanying drawings, forming part hereof, similar reference characters designate corresponding parts.

FIG. 1 is a perspective view of an angular scissor action cylinder, belonging to prior art, with portion of the external housing shown broken away for revealing weaknesses of the scissor action design.

FIG. 2 is a perspective view of the invention with portion of the external housing and drum wall shown broken away for revealing:

- a rotatable drum;
- a pair of radial pistons as part of the rotatable drum;
- inner rotor with a pair of inner radial pistons rigidly attached to it;
- intake and exhaust ports;
- pairs of sealing elements along the sliding edge of radial pistons;
- a center shaft attached as an intergral part of the drum.

Figure 3:
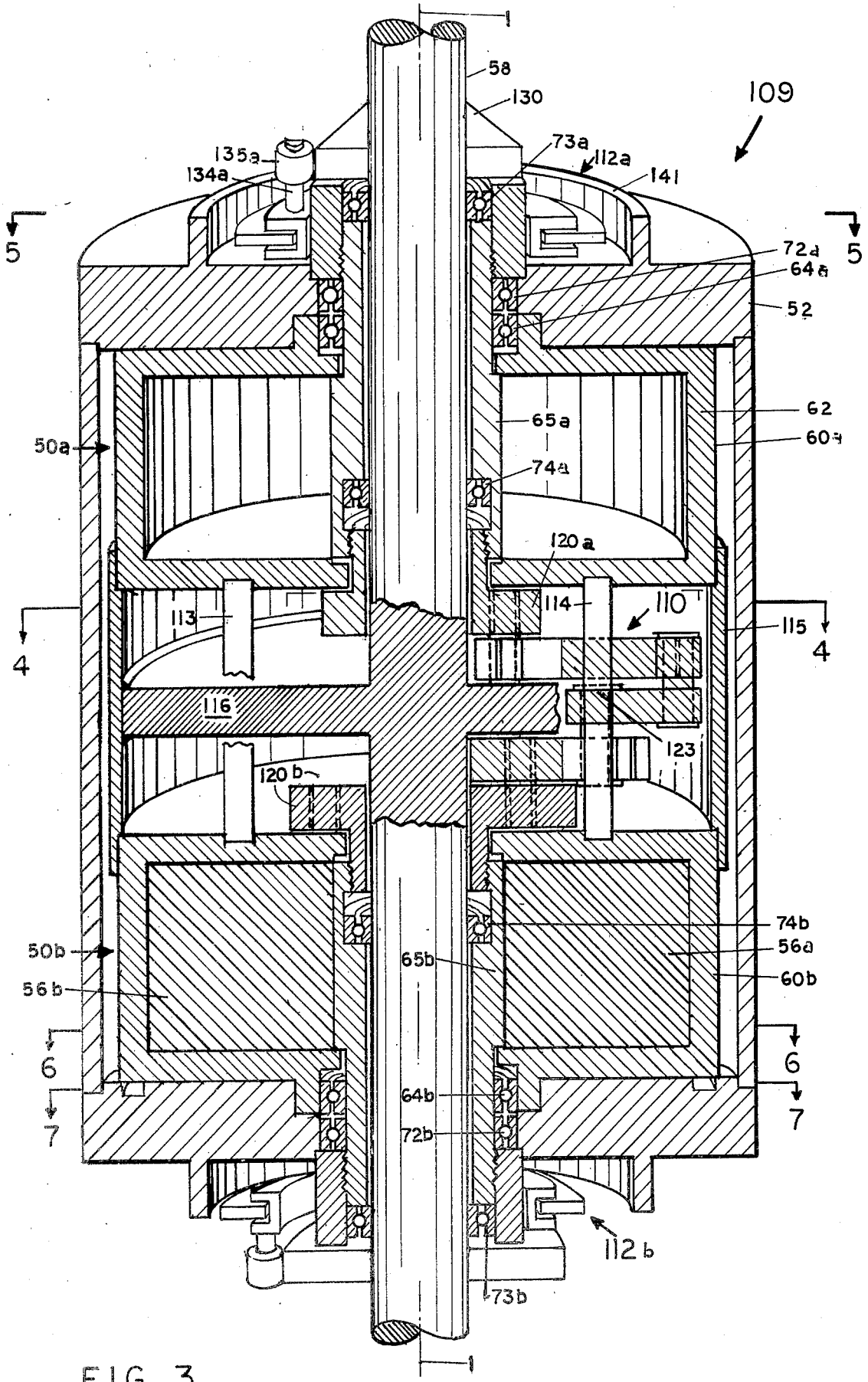

FIG. 3 is an external perspective view of a Tri-Rotor device comprising two angular cylinders in accordance with the invention, with portion of the external housing broken away and the center portion of the device cross-sectionalized for revealing internal components and the interlinkage between the two sides of the device.

Figure 4A:
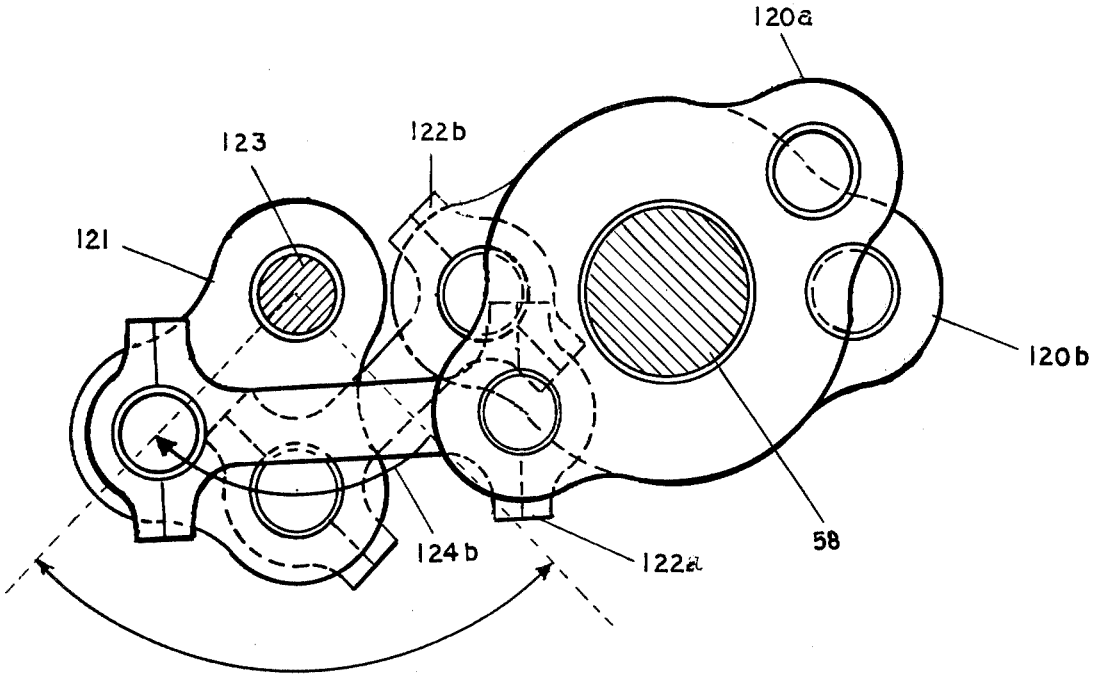
Figure 4B:
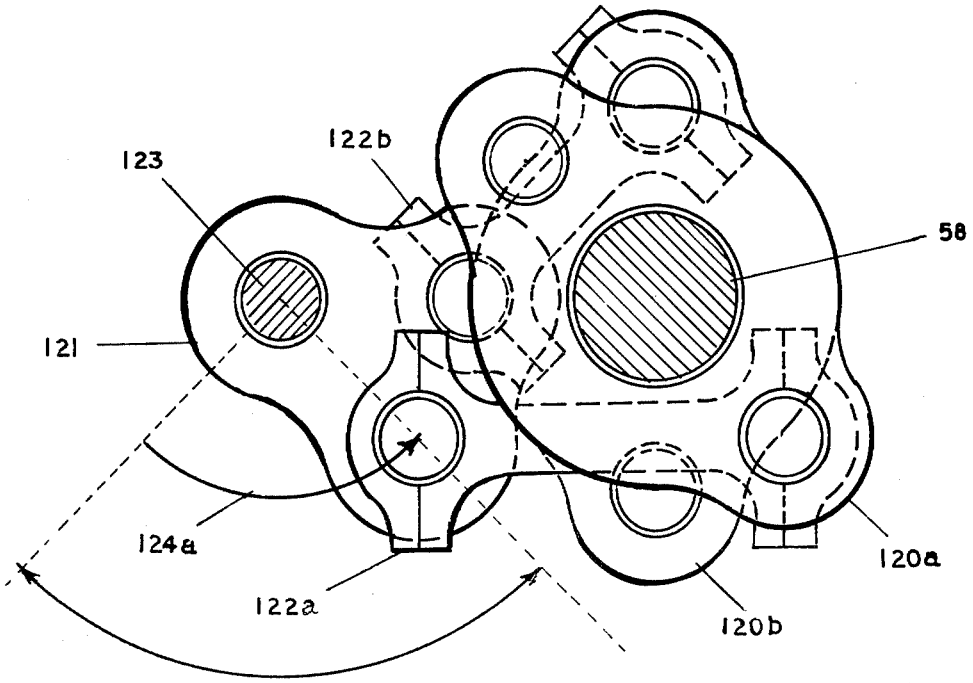

FIGS. 4*a* and 4*b* are cross-sectional plan views along line 4—4 of FIG. 3, showing two extreme positions of the unit interlinking the two sides of the device.

Figure 5:
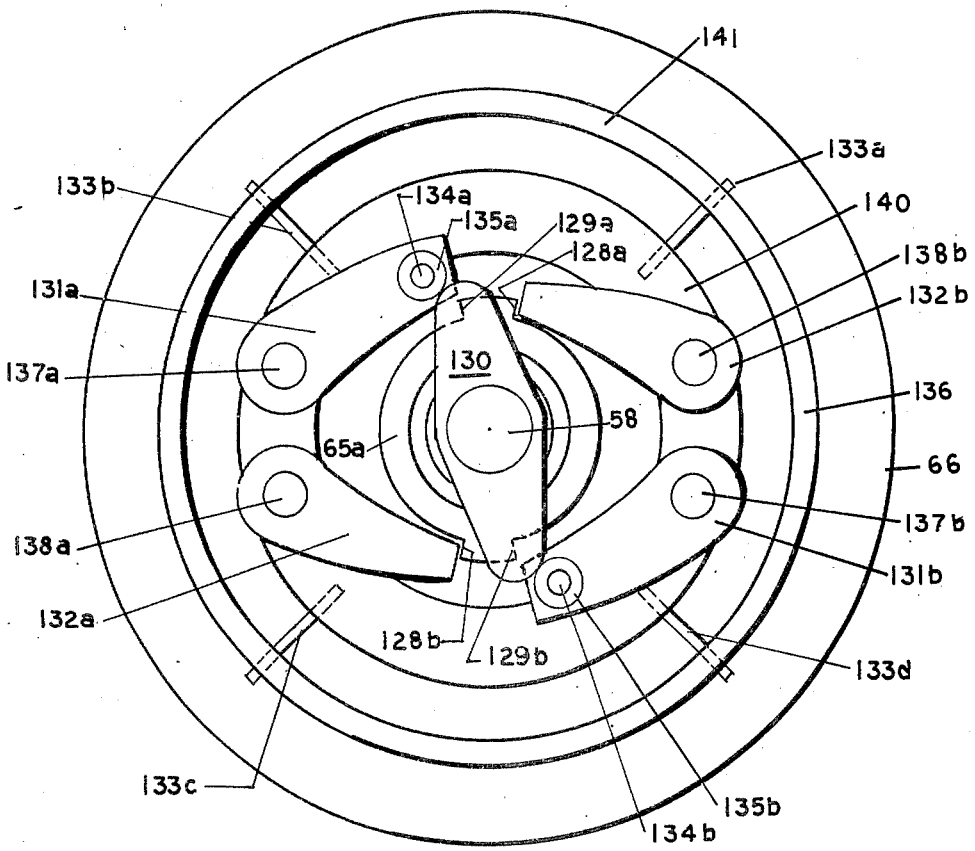

FIG. 5 is a plan view of the Tri-Rotor device of FIG. 3 showing rotor motion regulating means.

Figure 1:
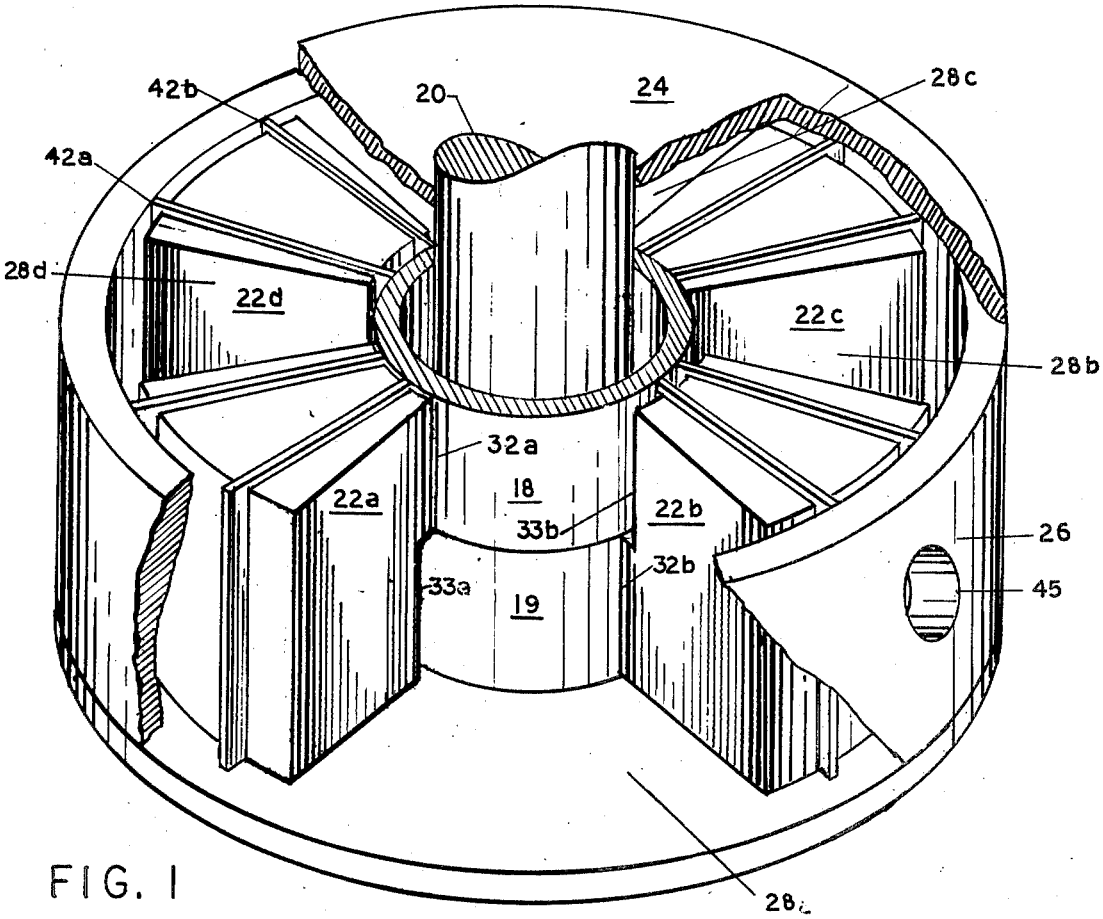
Figure 2:
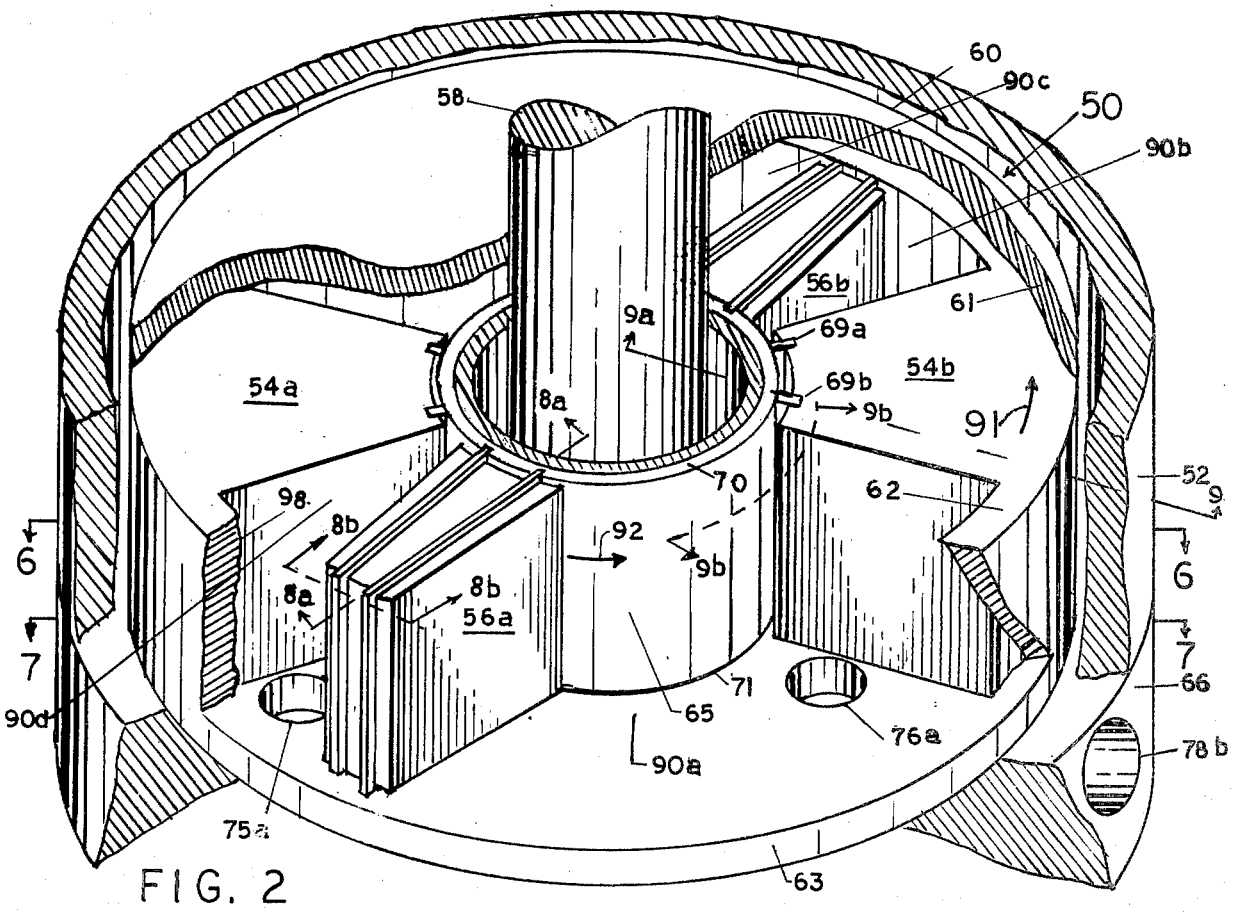
Figure 6:
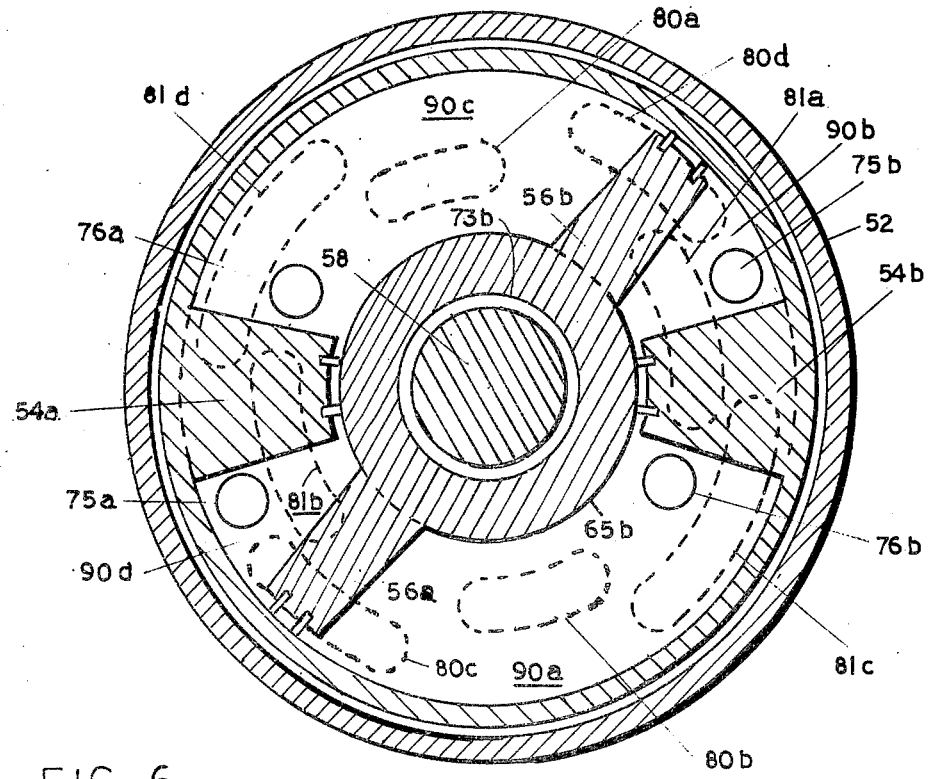

FIG. 6 is a cross sectional plan view across line 6—6 of FIG. 2 (also corresponding to line 6—6 of FIG. 3) showing intake and exhaust ports and cross sections of radial pistons; azimouthal slots on stationary housing are shown by dashed lines.

Figure 7:
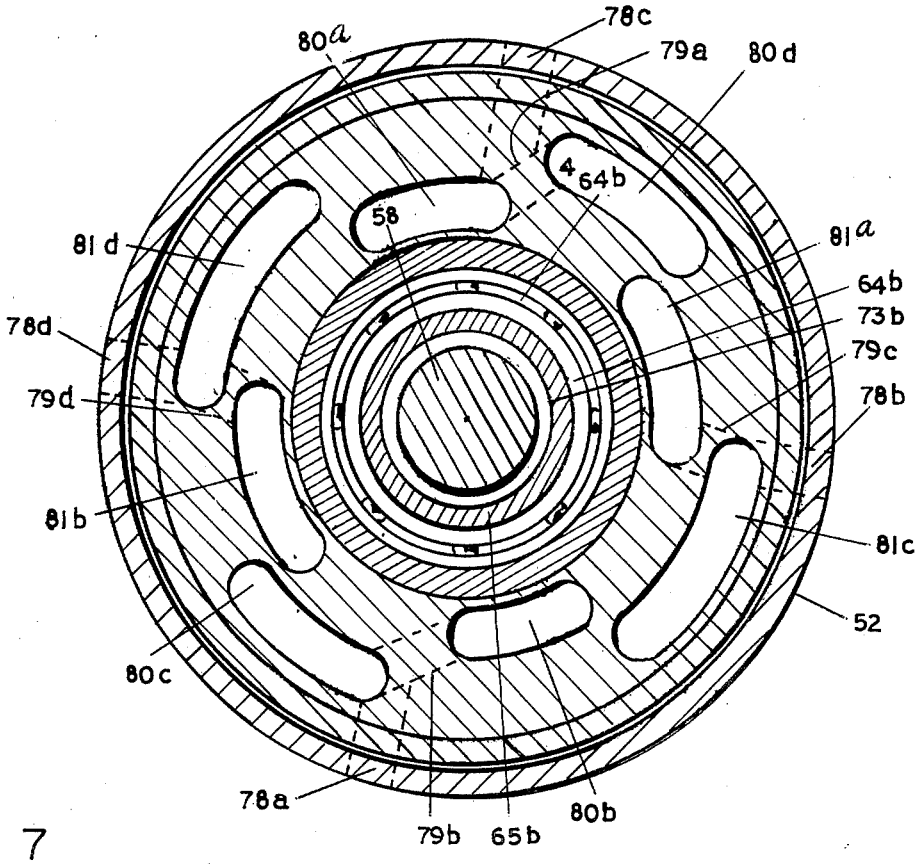

FIG. 7 is a cross sectional plan view across line 7—7 of FIG. 2 (also corresponding to line 7—7 of FIG. 3) for showing azimouthal slots and tunnels in base of stationary housing for feeding intake and exhaust ports.

Figure 8A:
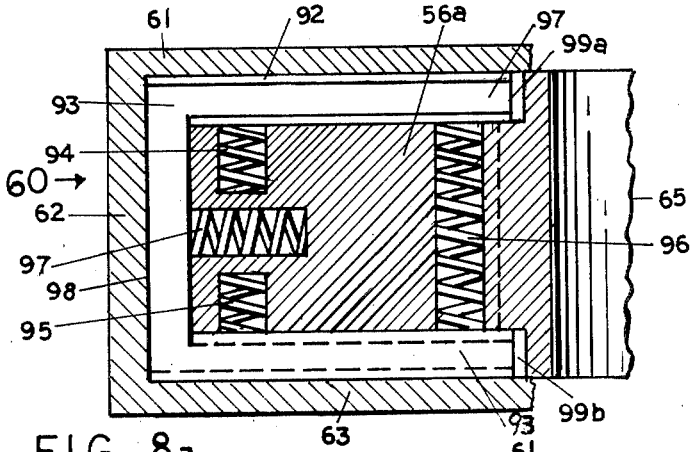
Figure 8B:
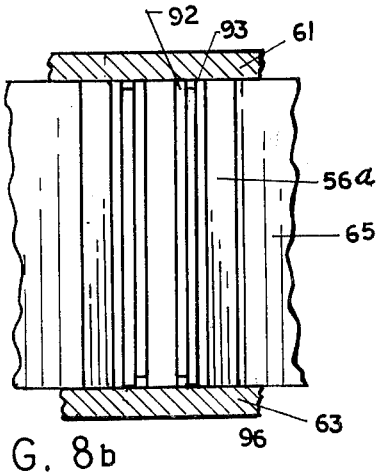

FIGS. 8*a* and 8*b* are cross sectional side views along lines 8*a*—8*a* and 8*b*—8*b*, respectively, of FIG. 2 for showing details of a preferred design of sealing elements used to seal the sliding surfaces of inner radial pistons and the internal surface of the drum.

Figure 9A:
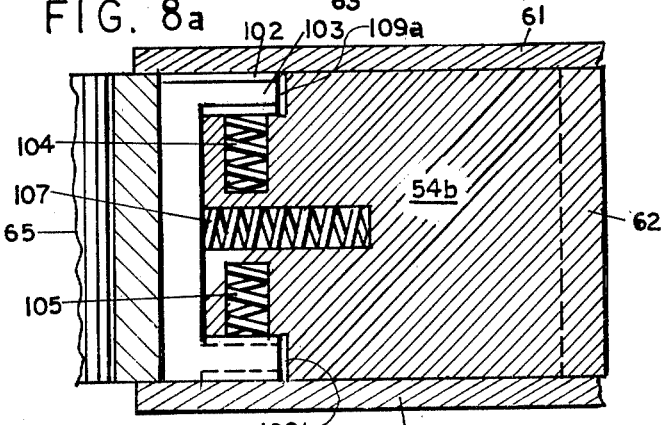
Figure 9B:
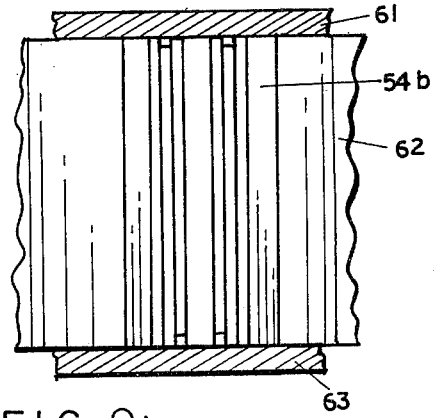

FIGS. 9*a* and 9*b* are cross sectional side views along lines 9*a*—9*a* and 9*b*—9*b* of FIG. 2 for showing details of a preferred design of sealing elements used to seal the sliding surfaces of outer pistons and the cylindrical surface of the inner rotor.

DETAILED DESCRIPTION OF THE PREFERRED EMBODIMENT

Referring to FIG. 2, there is shown an angular cylinder 50 in relation to a stationary housing 52. The angular cylinder 50 comprises a drum 60 which is cylindrical in shape having an outer cylindrical wall 62 and flat bases 61 and 63. The cylindrical wall 62 and the bases 61 and 63 are connected together into an integral rigid drum. The angular cylinder 50 comprises internally a pair of outer radial pistons 54*a* and 54*b* which are rigidly attached as an integral part of the external cylindrical wall 62, and the bases 61 and 62 of the drum 60. The outer radial pistons 54*a* and 54*b* are thus supported on three sides by the walls of the drum 60. The drum 60 is rotatably supported by a bearing 64 not shown in FIG. 2 (shown in FIG. 3 as 64*a*, 64*b* and in FIG. 7 as 64*b*). The drum 60 is rigidly connected with a center shaft 58.

Internally, between the bases 61 and 63 and concentrically with the drum 60, the angular cylinder 50 contains an inner rotor 65 having rigidly attached to it inner radial pistons such as 56*a* and 56*b*. The inner rotor 65 is radially supported by the housing 66 through a bearing 72, not shown in FIG. 2 (shown in FIG. 3 as bearing 72*b*). The center shaft 58 is kept radially aligned with respect to the angular cylinder 50 through bearings 73 and 74 not shown in FIG. 2 (shown in FIG. 3 as 73*a*, 73*b*, 74*a*, 74*b*). The axial position of rotor 63 is held fixed and the rotor is prevented from moving axially by its steps 70 and 71 which slide on the internal wall of the drum bases 61 and 63, respectively. Such sliding contacts may be direct or through thin washers of special bearing material with better frictional properties than the metals of the drum and inner rotor.

The fluid intake and exhaust ports such as 75*a*, 75*b*, and 76*a*, 76*b* are openings on one of the bases of the drum 60. Ports 76*a*, 76*b*, 75*a*, 75*b* with exhaust aximouthal slots 81*a*, 81*b*, and 81*c*, 81*d* respectively are shown in FIGS. 6 and 7. Intake slots such as 80*a*, 80*d*, and 80*b*, 80*c* are joined through tunnels such as 79*a* and 79*b* respectively. Also exhaust slots such as 81*a*, 81*c* and 81*b*, 81*d* are joined through internal tunnels 79*c* and 79*d*. Groups of slots then communicate with the surface of the housing through internal tunnels in the bases of the stationary housing. For example, exhaust slots 81*a* and 81*c* and the internal tunnel 79*c* communicate with the opening 78*b* on the stationary housing.

The angular cylinder 50 comprises internally a number of outer pistons connected to the drum 60 and interleaved with equal number of inner pistons connected to the inner rotor 65. One, two or more radial pistons may be attached to the drum 60 and inner rotor 65. The Figures in this specification describe the case where 2 outer radial pistons 54*a* and 54*b* are provided by the drum 60 and 2 radial inner pistons 56*a* and 56*b* are attached to the inner rotor 65. The four radial pistons 54*a*, 54*b*, 56*a*, 56*b* divide the angular cylinder into four chambers 90*a*, 90*b*, 90*c* and 90*d*. If during the instant shown in FIG. 2 the drum 60 is assumed to rotate counterclockwise in the direction of the arrow 91 with a rotational velocity Wo, and the inner rotor 65 (with pistons 56*a* and 56*b*) to rotate in same rotational direction, shown by an arrow 92, with a rotational velocity 2Wo, then chambers 90*a* and 90*c* will be contracting and chambers 90*b* and 90*d* will be expanding.

Sealing Elements

Tight pressure separation between chamber is accomplished through sealing elements positioned around the edge of the radial pistons along the sliding surfaces. The preferred design for such sealing elements is shown in FIG. 8*a*, 8*b* and 9*a*, 9*b*. FIGS. 8*a* and 8*b* show "U" Shaped double blade sealing elements, 92 and 93 for the purpose of sealing three sides of the inner pistons 56*a* and 56*b*. The blades 92 and 93 are shown to have one leg 97 narrower than the other leg 98, so that each leg of the sealing element comprises one narrow blade leg and one wider blade leg. Springs such as 94, 96, and 95 are then used to urge blade 92 towards one base 61 of the drum 60 and blade 93 towards the other base 63 of the drum 60. Both blades 92 and 93 have same width along the intermediate section of the blades. A spring such as 97 therefore can urge both blades towards internal surface of the drum 98. A small space is allowed between the end of the legs of the sealing elements and the bottom of slots such as 99*a* and 99*b* cut on the inner rotor 65 to take up temperature expansion of the sealing elements.

FIGS. 9*a* and 9*b* show double blade sealing elements similar to those shown in FIGS. 8*a* and 8*b* for sealing the side of the outer radial pistons such as 54*a* and 54*b* with respect to the cylindrical surface of rotor 65. "U" shaped blades 102 and 103 have legs of unequal widths and are place together in such a way that one wide leg rests next to a narrow leg. Springs such as 104 and 105 then urge blade 102 towards the base 61 of the drum 60 and blade 103 towards the base 63 of the drum 60, respectively. Spring 107 urges both blades 104 and 105 towards the cylindrical surface of the inner rotor 65. Small clearances 109*a* and 109*b* are left at the two extremities of the sealing elements for temperature expansion.

Applications

The angular cylinder of the present invention can be applied in the design of various devices such as compressors, pumps, steam engines, geothermal engines, air motors, hydrostatic pressure engines, internal combustion engines and the like.

If the fluid which is being intaken in the expanding chambers 90*b* and 90*d* through an intake port comes under pressure higher than the pressure in the exhaust port, force can be exerted on the surface of the radial pistons causing them to be angularly displace. When a structure is angularly displaced by an angle $d\Theta$ under a torque T the work performed by the fluid on the system is $dw = Td\Theta$. This work, as it will be explained later in connection with FIG. 3, can be provided as output on the body of the drum 60 and therefore on the output shaft 58. In this case the angular cylinder can act as an engine converting external pressure, present in the intake fluid, into torque at the output shaft 58. When the fluid is steam under pressure the device can act as a steam engine. When the fluid is a geothermal gas under pressure the engine can act as a geothermal engine. The energy in the steam or geothermal gas in such cases is being converted by the engine into torque. This engine can also act as an air motor, as the device is referred to when the pressure comes from a high pressure tank whose energy is being converted into torque.

When the fluid is a liquid under pressure as it would be water under a hydrostatic pressure the engine can act as a high efficiency hydrostatic torque generator. Since rotation of the drum 60 can be made to correspond exactly with the amount of fluid passing through the angular cylinder, the device can also be used as a fluid measuring unit as it would be a water meter or a gasoline pump.

When the purpose of the angular cylinder 50 is to raise the pressure of the intake fluid to a higher pressure at the exhaust port the device will act as a compressor. Such compressors can be used in air conditioning installations, refrigerators, freezers, dehumidifiers, and the like. Compressors are also used for storing high pressure in pressure tanks for driving automatic machinery, for tire inflation at the gas stations, and the like. It should be noted that the work involved in compressor and pump applications must be externally provided to the angular cylinder through the shaft 58 or directly through gear s to the drum 60. It may further be noted that the angular cylinder 50 may be used to provide a vacuum pump by connecting the intake port to the vacuum tank.

The angular cylinder of the present invention has direct utility to make up the angular cylinder required in the design of the Three-Rotor engines described in the said U.S. Pat. No. 3,989,012.

Description of the Tri-Rotor device Using Present Angular Cylinders

FIG. 3 shows an improved Tri-Rotor device using angular cylinders in accordance with the present invention. Referring now to FIG. 3 a Tri-Rotor device 109 is shown to comprise two angular cylinders 50*a* and 50*b* inside a stationary housing 52. An interlinkage unit 110 also shown in detail in FIGS. 4*a* and 4*b* serves to properly interlink the two angular cylinders 50*a* and 50*b*. Rotor control mechanisms 112*a* and 112*b* also shown in greater detail in FIG. 5 serve to regulate the motion of the inner rotors 65*a* and 65*b* as a function of the angular rotation of the shaft 58. Both drums 60*a* and 60*b* are rigidly connected to each other by spacing posts such as 113 and 114, and by a cover cylinder 115. The spacing posts such as 113, 114 are rigidly connected with a plate 116, which in turn is rigidly connected to the center shaft 58. Therefore, the two drums 60*a* and 60*b*, the cover cylinder 115, the spacing posts 113 and 114, and the shaft 58 all rotate together, preferably at substantially uniform speed, about the axis of the device 1-1.

The center shaft 58 is rotatably supported by the two inner rotors 65*a* and 65*b* through pairs of radial bearings 73*a*, 74*a* and 73*b*, 74*b*, respectively. The drums 60*a* and 60*b* which are an integral part with the center shaft 58, are also rotatably supported by the inner rotors 65*a* and 65*b* through radial bearings 64*a* and 64*b*, respectively. The entire system just described, comprising the center shaft 58, the two rotors 65*a* and 65*b*, the two drums 60*a* and 60*b* and the cover cylinder 115 and spacer posts 113 and 114, is then rotatably supported by the stationary housing through two bearing 72*a* and 72*b*.

The function of the interlinkage unit 110 has been described in said U.S. Pat. No. 3,989,012. For the sake of completeness it is stated here that the interlinkage unit 110 acts as a differential unit interconnecting the inner rotor 65*a* with the inner rotor 65*b*.

The two inner rotors are an inherent requirement of the Tri-Rotor design with the two drums and an axially located output shaft providing a third rotor which interacts with both inner rotors. While a single drum may be used in the Tri-Rotor configuration the two inner rotors are necessary. The necessity of the two rotors comes from the fact that one of the rotors advances in the forward direction while the other rotor reacts in the opposite direction with the stationary case. Another function of the pair of inner rotors is that stepping of one rotor and accelerating the other at exactly the same rates involves a smooth exchange of rotational momentum between the two rotors.

Providing a second drum in the Tri-Rotor configuration, while not absolutely necessary, is very desirable, for the following reasons:

(a) It can double the power output of the device with only a small percentage of additional volume, weight, and expense;

(b) Each angular cylinder has two types of chamber. Type A chamber has the inner piston preceeding the chamber and being accelerated to a rotational velocity 2Wo, during expansion of the chamber. Type B chamber has during expansion, an outer piston preceeding the chamber and moving with a substantially constant velocity Wo, while the internal piston is forced to decelerate to zero velocity against the stationary case. It should be noted that in a drum alternately type A chambers expands, then type B chambers do so, and so on. Further, in a full Tri-Rotor configuration, providing two drums, while type A chambers undergo expansion in one of the drums the type B chambers undergo expansion in the other drum so that both types of expansion take place during each stroke. This provides for distribution of forces into both sides of the Tri-Rotor engine, reducing the overall stress for a particular power output, to one half, for the same size inner rotor and common inter-linkage unit.

(c) With the size of the intake and exhaust ports being limited by the relatively small size of the engine and considerations of high compression ratio, a Tri-Rotor device providing two drums effectively doubles the amount of fluid that can flow into the device and therefore providing a definite improvement in the volumetric efficiency of the device.

Alternately, the rotor 65*a* is prevented from rotating while the rotor 65*b* is free to rotate; then the rotor 65*b* is prevented from rotating while the rotor 65*a* is free to rotate during the time intervals that it takes for the constantley rotating drums to rotate substantially through 90 degrees.

Let us assume that the Tri-Rotor device 109 acts as a steam engine at the particular interval when the rotor 65*a* is free to rotate while the rotor 65*b* is held fixed. In the drum 65*a* each inner radial piston will receive torque F so the rotor 65*a* will receive a total of 2F torque and since the rotor 65*b* is held fixed the output shaft will effectively see a torque of 4F in the positive rotational direction. Simultaneously each outer radial piston will see a torque of −F since it follows the pressure providing steam, a total of −2F received by the two outer pistons. Since the outer pistons are directly connected to the shaft 58 the −2F torque from the outer pistons will be equally reflected to the output shaft 58 as −2F. Therefore, the total output torque by the drum 60*a* will be 4F−2F=+2F. The angular cylinder 50*b* will also provide +2F torque, F on each outer radial piston, which in this case preceeds the pressurized steam. The inner radial pistons of rotor 65*b* will provide zero torque during this interval as they are held fixed. During the next interval the function of the angular cylinder 50*a* and 50*b* will be interchanged with rotor 65*a* to be held fixed. But regardless of the time interval being considered each angular cylinder will contribute torque of 2F to the output shaft 58; therefore, the output shaft 58 will receive a total torque of 4F from the two drums. In general the output torque is equal to the torque applied on the surface of a piston multiplied by the half of the total number of the pistons.

FIG. 3 shows the rotors 65*a* and 65*b* to end towards the center of the device 109 into plates 120*a* and 120*b*, respectively. The operation of the interlinkage unit 110 is best shown in FIGS. 4*a* and 4*b*. The plates 120*a* and 120*b* are connected via connecting rods 122*a* and 122*b* with a rocker 121 which is pivoted about a shaft 123. The shaft 123 can be one of the spacer posts, such as 114 rigidly supported by both drums 60*a* and 60*b*. When the rotor 65*a* with the plate 120*a* rotates counterclockwise the connecting rod 122*a* pulls the rocker 121, forcing it to also rotate counterclockwise at substantially same angle. Simultaneously the connecting rod 122*b* urges the plate 120*b* in the clockwise direction. Therefore, the rotation of the rocker in a particular direction urges the two inner rotors 65*a* and 65*b* to rotate in opposite directions. However, if one of the inner rotors is held fixed the motion of the other inner rotor causes motion of the assembly of drums and shaft in the same direction as the free inner rotor. After the rotors reach the extreme position shown in FIG. 4*a* as the rocker 121 rotates in the direction of the arrow 124*a* the fixed rotor is released and the rotor, which was free now becomes fixed. The rocker 121 now reverses its direction of motion, going in the direction shown by the arrow 124*b* in FIG. 4*b*. The final relative position of the rotor plates 120*a* and 120*b* and rocker 121 after the rock rotates by 90 degrees, is shown in FIG. 4*b*. It should be noted that since only one of the rotor plates moves during each displacement the relative positions of the rotor plates 120*a* and 120*b* shown in FIGS. 4*a* and 4*b* are attained because of the actual rotation of the drums, 60*a* and 60*b* which carry the rocker 121, in the counterclockwise direction.

Rotor Motion Regulation Mechanism

The means used to hold one inner rotor fixed while allowing the other rotor to move forward can be a very involved mechanism. The sophistication involved in the design of such a mechanism can greatly contribute to the overall efficiency of the device.

FIG. 5 shows simple basic means for stopping one inner rotor 65*a* to provide ratchet steps 128*a*, 128*b*, 129*a*, 129*b*. The pair of steps 129*a*, 129*b* interact with forward pawls 131*a*, 131*b*, to prevent the inner rotor 65*a* from rotating counterclockwise during the time it takes for the center shaft 58 to rotate 90 degrees. The counterclockwise direction of rotation is assumed to be the positive direction of rotation. Assuming steam entering the two chambers of the drum 60*a* during the interval in which rotor 65*a* is held fixed, the pressure of the steam will urge the inner radial pistons to reverse their motion and move in the negative direction. The ratchet steps 128*a*, 128*b* of the inner rotor 65*a* will then interact with the pair of rear pawls 132*a* and 132*b* and prevent the rotor 65*a* from moving in the negative direction. A cam 130, rigidly attached and rotating with the shaft 58 is shown in FIG. 5 at the instant when it acts upon rollers 135*a* and 135*b* rotatably supported on the pawls 131*a* and 131*b*, through shafts 134*a* and 134*b* for displacing the pawls radially, outwardly, and thereby disengage the inner rotor 65*a* from the forward pawls 131*a* and 131*b*. The inner rotor 65*a* will then rotate 180 degrees before it becomes reengaged with the pawls 131*a* and 131*b*, while the center shaft 58 will be displaced 90 degrees. During the next 90 degrees rotation of the center shaft 58 the inner rotor 65*a* will remain engaged. It will again be disengaged at the end of such 90 degree rotation of the center shaft. So that the inner rotor 65*a* remains engaged with the pawls 131*a* and 131*b* during every other 90 degree rotation of the center shaft 58. A similar mechanism, acting on the inner rotor 65*b* keeps it engaged and therefore fixed during the 90 degree intervals during which the rotor 65*a* is free to rotate and vice versa.

Spring action is provided to the system by supporting the pawls on a circular ring 140 which, in turn, is being suspended by blade springs such as 133*a*, 133*b*, 133*c*, and 133*d* from the cylindrical ridge 141, which is rigidly connected to the housing 66.

It should be noted that while the rotation of the center rotor 58 provides the criterion for engaging and disengaging the inner rotor at the end of each 90 degree interval, the exact time of release or engagement can be advanced as a function of speed or internal pressure towards smooth engagement and disengagement.

During normal operation, for example, a forward moving rotor such as rotor 65*a* does not have to be stopped by the forward pawls 131*a* and 131*b*. As the drum such as 60*a* is rotating with a velocity Wo and a forward moving inner rotor such as 65*a* is rotating with a velocity 2Wo the inner pistons are approaching the outer pistons at a relative velocity of Wo. If the angular slots such as 81*a* and 81*b*, which provide communication between the contracting chambers and the external sink, end beyond a predetermined angle, as the two radial pistons are approaching each other, the remaining steam in the closed chambers will be compressed and will act as a cushion on which the velocity of the inner piston, with respect to the outer piston will be reflected. The +Wo velocity of the inner piston with respect to the outer piston will be reflected as −Wo velocity with respect to the outer piston and with the latter rotating at a substantially uniform velocity Wo with respect to the housing the reflected velocity of the inner rotor will be zero velocity with respect to the housing. At this instant the entire angular momentum of the inner 65*a* rotor will have been transferred to the center shaft 58 which is connected to the load. Let us assume that the position of the inner rotor 65 at this time is such that the steps 128*a* and 128*b* have just passed the tips of the rear pawls 132*a* and 132*b*. Next, with the introduction of new steam, as the ports of the expanding chambers will now reach the intake slots 80*a* and 80*b*, the rotor 65*a* will reverse velocity and travel for a short interval clockwise until it will be stopped by the rear pawls 132*a* and 132*b* as they will engage with the inner rotor ratchet steps 128*a* and 128*b*. It should be noted that the engagement between ratchet steps 128*a*, 128*b*, and pawls 132*a*, 132*b* can be very smooth because of the low relative velocity between the inner rotor 65*a* and the external housing. Further the plate 140, holding the pawls, can provide spring action as it is suspended by the spring blades 133*a*, 133*b*, 133*c*, and 133*d*. The force provided by the steam will store some energy as potential energy in the spring blades; substantially all of such energy will be returned to the system as the pressure of the steam will be lowered due to expansion of the chambers. This energy can be used to provide initial motion of the inner piston during its next excursion. Most of the acceleration energy of inner pistons will be provided by the rotational momentum of the drum. Because of the interlinkage unit 110 the size of the contracting chambers in the drum 60*a* is substantially the same at any instant as the size of the contracting chambers in the drum 60*b*. Therefore, as the velocity of a rotating inner piston is reflected from +Wo to −Wo, with respect to the rotating drums simultaneously the velocity −Wo of the stationary inner rotor with respect to its drum is similarly reflected to become +Wo, corresponding to +2Wo with respect to the stationary housing. This implies that the inner rotor, being slowed down, is being decelerated at substantially the same rate as the other rotor is being accelerated. As the decelerating rotor passes its angular momentum to the rotating drum the accelerating rotor takes angular momentum at substantially the same rate from the rotating drum. Angular momentum is therefore shifted between the rotors 65*a* and 65*b* while the angular momentum of the drums and shaft assembly remains substantially uniform. The steam will provide torque to the output shaft 58 through the outer piston and through the interlinkage unit.

It is to be noted that instead of the pawls and ratchets other equivalent mechanisms such as over-riding clutches, magnetic clutches and the like may be used between each inner rotor and the stationary housing to control the motion of the inner rotors.

In the case where the Tri-Rotor device is used as a compressor the center shaft 85 is being driven by an external torque, while the pawls serve to regulate the motion of the inner rotors.

What is claimed is:

1. An angular cylinder for providing angular expanding and contracting chambers comprising;

a housing representing a stationary frame of reference having an imaginary axis for providing a line of reference;

a cylindrical drum symmetrically disposed around said axis having an outer cylindrical wall and two base walls;

an input/output shaft located along said axis and rigidly connected to said drum for providing an input and/or output torque;

N outer pistons integral with said drum and extending radially inwardly from said outer cylindrical wall of said drum and between said two base walls of said drum, each outer piston providing ends to two adjacent angular chambers inside said drum;

a first inner rotor telescoped around said input/output shaft for providing an inner cylindrical surface to said drum;

N inner radial pistons rigidly attached to said first inner rotor and extending radially outwardly from said first inner rotor toward said cylindrical wall and interleaved with said N outer radial pistons, each inner radial piston used for providing an azimouthal end to two adjacent angular chambers, whereby a cylindrical volume inside said drum is totally divided into 2 N angular chambers, N chambers being contracting and the other N chambers being expanding upon relative rotation of said drum and said first inner rotor;

a first abutment means for interengaging said first inner rotor and said housing thereby providing reaction between said first inner rotor and said housing at predetermined intervals of rotation of said input/output shaft;

a second inner rotor telescoped around said output shaft and angularly displaced with respect to said first inner rotor along said shaft for providing complementary action and balancing the rotational momentum of said first inner rotor;

a second abutment means for interengaging said second inner rotor and said housing for providing reaction between said second inner rotor and said housing, intermittently with said first abutment means;

differential action means for interengaging said first inner rotor, said second inner rotor and said output shaft whereby a first torque applied in a selected rotational direction to one of said inner rotors results in equal and oposite torque on the other inner rotor and a torque equal to twice the first torque into said input/output shaft;

first rotor limiting means for preventing forward rotation of said first rotor during a predetermined rotational interval of said input/output shaft;

a second rotor limiting means, intermittently operable with said first rotor limiting means for limiting the rotation of said second inner rotor during a predetermined rotational interval of said input/output shaft, whereby during one selected interval said first inner rotor moves forwardly to a predetermined rotational angle with respect to said shaft, while said shaft is displaced in a forward direction by an equal angle with respect to said second rotor;

and during a next interval said second rotor is displaced forward to a predetermined rotational angle with respect to said shaft while said shaft is being displaced forward an equal angle with respect to said first inner rotor;

intake and exhaust means for intaking a fluid into expanding chambers and expelling such fluid from contracting chambers;

and means for rotatably supporting said drum and said inner rotors on said housing.

2. The device of claim 1 wherein said differential action means comprises;

a rocker, rotatably supported by said drum;

at least one connecting rod for connecting said first inner rotor with said rocker; and at least one other connecting rod for connecting said second inner rotor with said rocker.

3. The device of claim 2 wherein a second angular cylinder is provided around said second inner rotor comprising a drum including a cylindrical wall and two base walls and having radially inwardly extending outer radial pistons connected thereto, said second inner rotor including inner pistons extending radially outwardly from said second inner rotor and interleaved with said outer pistons of said second angular cylinder, said second angular cylinder and said former mentioned drum being rigidly connected to said input/output shaft and comprising a single unit rotating substantially uniformly with respect to said housing for balancing the rotational momentum of said first inner rotor by providing a system whereby the sum of the angular momentums of said first and said second inner rotors remains substantially constant for a particular rotational speed of said input-/output shaft for increasing the volumentric efficiency during successive expansion and contractions of said chambers.

4. An angular cylinder piston combination as claimed in claim 3 including side opposed drum plates, pivots connected to said plates for supporting said differential device interposed between said two inner rotors.

* * * * *